United States Patent [19]

Paurat et al.

[11] 4,451,089

[45] May 29, 1984

[54] COAL-MINING MACHINE

[76] Inventors: Friedrich W. Paurat, Kasselweg 29; Roland Paurat, Blumenstr. 11, both of 4230 Wesel, Fed. Rep. of Germany

[21] Appl. No.: 334,068

[22] Filed: Dec. 23, 1981

[30] Foreign Application Priority Data

Dec. 24, 1980 [DE] Fed. Rep. of Germany ..... 3048939

[51] Int. Cl.[3] ..... E21C 35/22

[52] U.S. Cl. ..... 299/43; 299/81

[58] Field of Search ..... 299/43, 17, 18, 81; 251/325, 149.8; 137/616.7, 503

[56] References Cited

U.S. PATENT DOCUMENTS

| | | | |
|---|---|---|---|
| 2,690,807 | 10/1954 | Moosman | 251/149.8 |
| 3,071,193 | 1/1963 | Raulins | 251/325 X |
| 3,747,982 | 7/1973 | Agnew et al. | 299/81 |
| 3,887,235 | 6/1975 | Koppers | 299/43 X |
| 4,049,318 | 9/1977 | Fruin | 299/81 |
| 4,068,893 | 1/1978 | Weirich | 299/17 X |
| 4,095,845 | 6/1978 | Paurat | 299/18 |
| 4,118,072 | 10/1978 | Kelley et al. | 299/43 |
| 4,274,434 | 6/1981 | Häfele | 137/503 X |

*Primary Examiner*—James A. Leppink
*Assistant Examiner*—Beverly E. Hjorth
*Attorney, Agent, or Firm*—Karl F. Ross; Herbert Dubno

[57] ABSTRACT

An excavating machine, e.g. for the recovery of coal and its removal from a coal seam comprises a rotary excavating tool which consists of a plurality of neutrally articulated coal augers which are driven and are disposed against the face to be excavated. The coal augers are provided with nozzles for spraying water or some other fast settling and spark-inhibiting liquid, the nozzles being controlled by a valve which opens flow to the nozzles only when at least one auger is disaligned from an adjustive auger as is required for coal cutting operations with such tools.

5 Claims, 9 Drawing Figures

COAL-MINING MACHINE

FIELD OF THE INVENTION

Our present invention relates to a coal mining machine and, more particularly, to a machine for full-face excavation of mineral matter in a tunnel or the like and adapted to cut away the coal or rock and to displace the resulting detritus away from the advancing front.

BACKGROUND OF THE INVENTION

In order to fully appreciate the following discussion regarding the background of the present invention, reference may be had to the following U.S. patents filed by one or both of us:

U.S. Pat. No. 4,095,845;
U.S. Pat. No. 4,173,836;
U.S. Pat. No. 4,274,675;
U.S. Pat. No. 4,247,997;
U.S. Pat. No. 4,231,618;
U.S. Pat. No. 4,278,293.

Reference may also be had to the patents and publications described in these patents and to German patent documents Nos. 25 33 518 and 26 20 388.

In recent years coal mining machinery has been developed in which coal augers, i.e. rotary bodies provided with conveyor-type worm flights, picks and the like, are thrust against a coal face in a direction generally transverse to the axis of rotation of the auger which cuts away the coal and, by a conveyor action, shifts the same to a side.

Articulated auger systems have also been provided so that each section of length of the auger is articulated to at least one of the sections and can be tilted relative thereto, e.g about an axis perpendicular to the plane of the axis of two adjoining sections.

A mining apparatus can also include a chassis movable along the mine tunnel, shuttering or shields which can be raised or otherwise pressed against the walls of the tunnel, the aforementioned tools, a prime mover or other drive for powering the shields and the chassis-displacement mechanism as well as driving the tools, and a conveyor system for carrying the removed product rearwardly, i.e. opposite the direction of advance of the machine.

Such conveyor means can include a conveyor trough into which the worm action of the auger or augers delivers the detritus and which is provided with a flight conveyor or the like for entraining this material opposite to the direction of advance of the mining front.

To permit the inclination of one auger section relative to another, universal or so-called Cardan joints can be provided between the sections.

Each auger section is associated with a trough section or apron, located behind and below the auger and forming a guide along which rotation of the auger and the helical flight thereof advance the excavated material to a side of the tunnel or, more precisely, toward one end or the other of the auger section depending upon the pitch of the flight.

Consequently, for excavation of a strip ahead of the segmented tool, one of the segments is pushed forwardly so that it is angularly offset from alignment with the next segment and an angular attack is effected upon the coal face. As excavation proceeds, the segments successively are urged forwardly until they have been partly or fully aligned whereupon the process is repeated and a progressive excavation of the coal is effected across the width of the mined face.

Naturally, for this movement of the auger section and the associated apron forwardly, the machine must be braced against reverse movement and generally between the bracing system for the chassis and each auger section two actuating members are provided, e.g. in the form of fluid-operated cylinders, which are capable of swinging each section into is aligned or angularly offset orientation.

To allow higher regions of the coal face to be excavated, means can be provided to swing the articulated segments upwardly. Such systems are particularly described in U.S. Pat. No. 4,095,845 and the German patent documents mentioned.

It may also be noted that there are systems known for wetting down the site of coal excavation to limit the billowing of dust, preventing sparking and minimizing the danger of explosion and health hazards.

Nozzle arrangements have been provided for this purpose in excavating devices but none has been successful as yet in an association with excavating means of the segmented auger type which have only limited portions of the length of the segmented tool in an excavating operation at any one time since the tool region of attack upon the mine face is at the segment which is inclined in the manner previously described.

OBJECTS OF THE INVENTION

It is the principal object of the present invention to provide an improved apparatus for the recovery of coal from a mine whereby the aforedescribed disadvantages are obviated.

Another object of this invention is to provide an improved angle mining machine of the segmented auger, wide-face type, which is safer to utilize and can provide for effective wetting of the dust generated by the excavating operation.

SUMMARY OF THE INVENTION

These objects and others which will become apparent hereinafter are attained, in accordance with the present invention, in a mining machine of the type described wherein a plurality of rotary auger-type tools are articulated end to end and are selectively urged against a tunnel face and are associated with respective aprons.

The invention provides a source of dust-wetting and spark-preventing liquid for the array of auger sections, nozzle means communicating with this source and valve means connected to the auger sections for selectively delivering the liquid to the nozzles of an auger section which is shifted relative to at least one other auger section to attack the tunnel face.

Since the auger sections are successively tilted out of alignment with the ineffective auger sections to attack the tunnel face in accordance with the principles of U.S. Pat. No. 4,095,845, for example, only the effective auger section (i.e. the auger section generally inclined to the direction of advance of the machine) receives the liquid to spray the excavating region, wet down the dust and prevent sparking while other sections which have not yet attacked the front in a similar way, do not spray the liquid.

The spray liquid is thus delivered to the sections in succession and in the order in which they are brought into attack against the coal face. Excess wetting is thereby avoided.

More specifically, the liquid supply duct communicates between two auger sections in the region of the articulation and advantageously extends through the articulation with the relative angular displacement of the two sections controlling the delivery of the liquid to the inclined or effective auger section.

This can be achieved in the system of the invention utilizing a valve which may be located elsewhere than at the articulation but which itself is controlled by the orientation of the articulation.

This valve is opened to deliver fluid to an angularly offset auger section and to block the flow to a non-offset section.

In other words, the invention utilizes the face, with a broad-front excavator of the type described having a number of excavating tools or augers in mutually articulated relationship so that the excavation is effected progressively across the front but transversely to the direction of advance of the tunnel by first inclining one auger section to excavate material, and then advancing this auger section into a noninclined state while inclining an adjacent auger section and so on across the front, to operate the liquid supply to the effective auger sections and thus limit liquid sprayed to the regions of greatest excavation.

The articulation between a pair of auger sections can be formed as a Cardan joint with length compensation, i.e. a joint which is capable of telescoping in the axial direction and the liquid supply line can have a corresponding length compensation which is utilized simultaneously to actuate the valve.

The latter compensating means can thus include telescoping tube portions including an inner tube and an outer tube with the inner tube having water outlet bores and the outer tube provided with a cylinder from whose chamber passages run to the nozzles. A cylinder section is effective in the shortened position of the compensating means to close off the supply of the water to the nozzles.

While it is possible to supply all of the nozzles of the active auger section with the spray liquid, it has been found to be advantageous also to prevent excess watering to limit the supply to a sector of the active auger which is actually attacking the face of the tunnel. Consequently, according to another feature of the invention, a distributing valve is provided which includes a nonrotating part connected to the supply tube and a rotating part connected to the rotating member of the auger whose nozzles are clearly subdivided into sectors. All of the nozzles of each sector are connected to a common feed passage terminating in the rotary member of the distributing valve which is centered on the axis of rotation of the lower section so that each passage, in turn, communicates with an outlet form by the nonrotatable valve member when the corresponding sector engages the rock face, the other passages being closed off.

The nonrotatable member can be weighted or otherwise inertially stabilized against rotation.

The inertial stabilization can be effected by an eccentric weight whose central mass hangs downward or, for example, by a water reservoir having a predetermined water level upon which a float rides to retain the nonrotatable member in place.

According to another embodiment of the invention, the articulation itself forms a valve, i.e. a throttle thereof when two parts are disaligned and the pressure differential across this throttle is used to control a slide valve for supplying the spray liquid. The spray liquid itself can thus be used as the hydraulic actuator for the larger valve.

Frequently the auger sections are driven by electric motors or are otherwise supplied with an electric source. In this case, the articulation can be provided with angular displacement sensors, e.g. strain gauge strips whose outputs are utilized to control electromagnetic valves which accomplish the same purpose.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
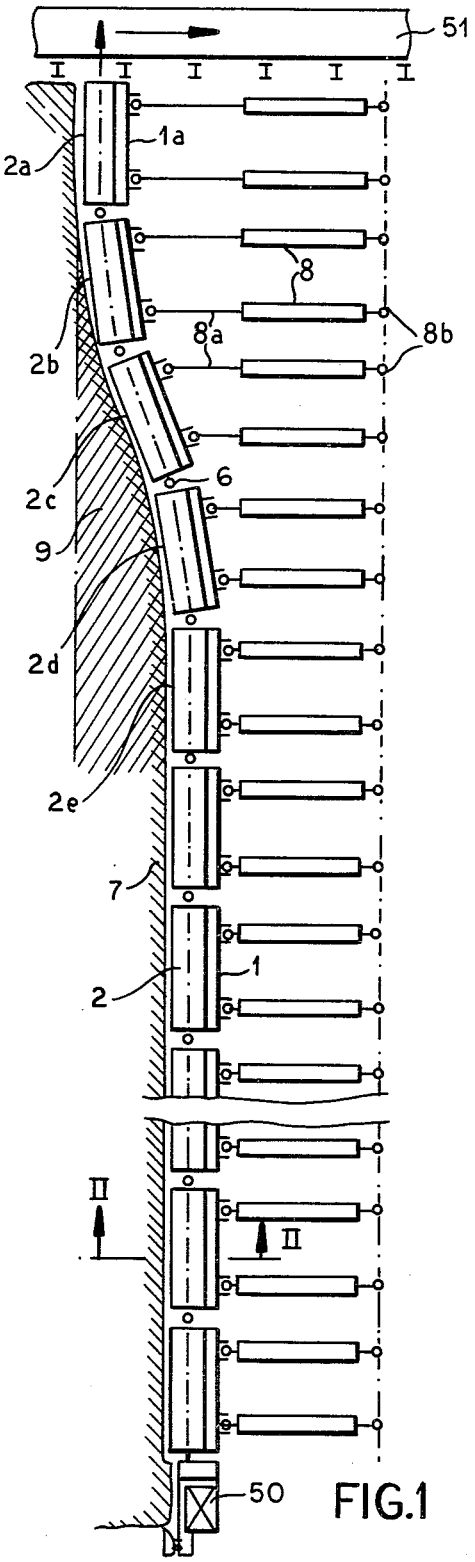
FIG. 1 is a plan view in a highly diagrammatic form illustrating a coal mining operation in accordance with the principles of this invention.
Figure 2:
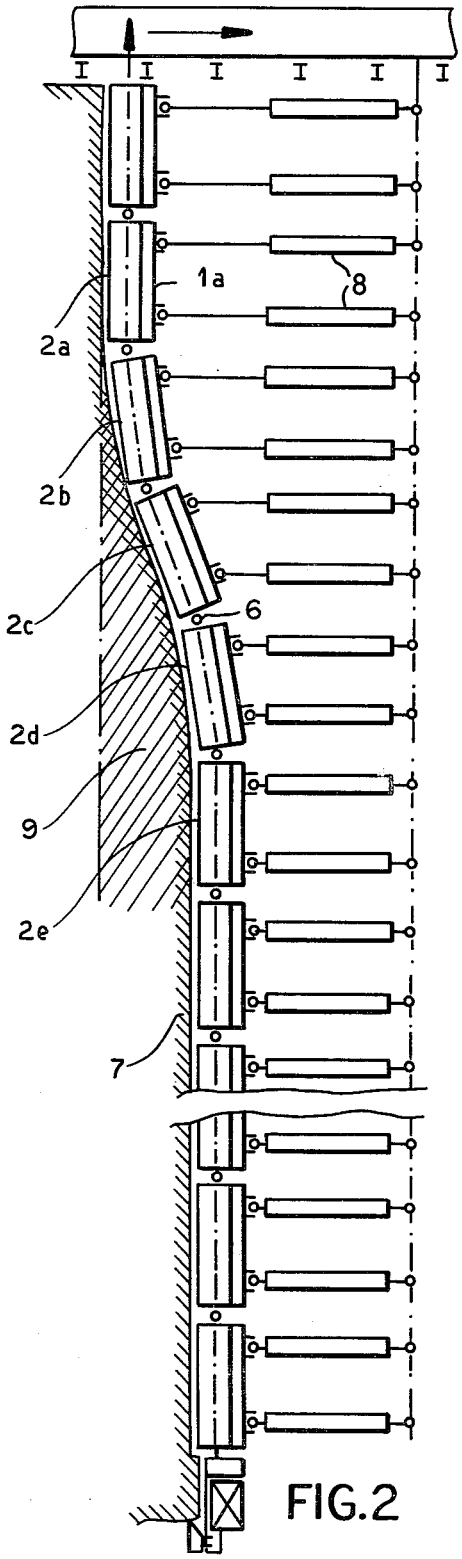
FIG. 2 is a similar view showing a further development of the mining operation.
Figure 6:
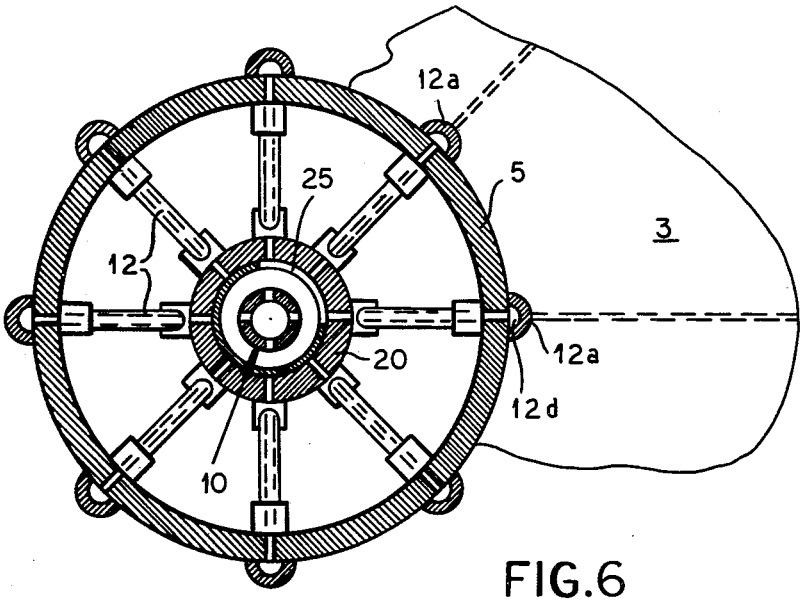
FIG. 6 is a transverse section through the shaft assembly shown in FIG. 4 and FIG. 5.

In FIGS. 1 and 2 we have shown a part of a coal-mining machine of the broad-face excavator type as described, for example, in U.S. Pat. No. 4,095,845, and of which the chassis, shields and power units have not been shown.

The machine comprises, in addition to these units, conveyor-forming aprons 1 (see FIGS. 1 and 3), each of which is associated with a respective coal auger section 2, the sections and the aprons being linked together, i.e. articulated at 6 to form a row as can be seen from FIGS. 1 and 2.

Figure 3:
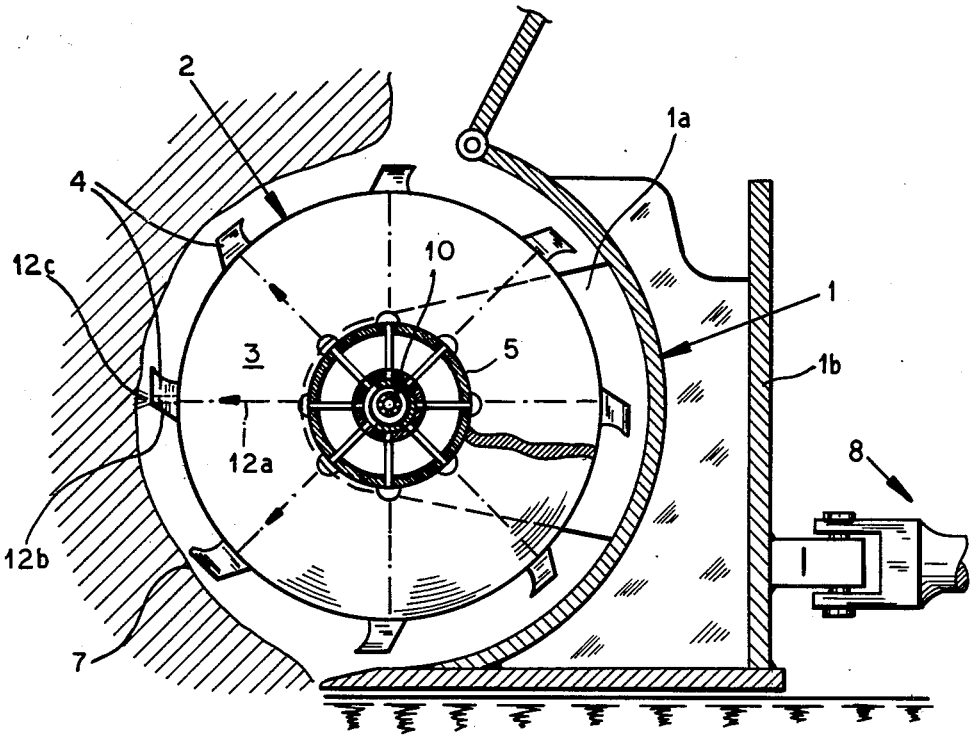
FIG. 3 is a section taken along the line III—III of FIG. 1, drawn to a larger scale.

Each auger is formed with a hollow shaft 10 and is journaled in a pair of trunnions 1*a*, only one of which can be seen in FIG. 3, to a support 1*b* for the apron 1.

As a comparison of FIGS. 1 and 2 will show, the excavation is effected by successively inclining the sections and forcing them forwardly while the entire assembly is rotated, e.g. by a drive represented at 50 in FIG. 1. At the opposite end of the assembly a conveyor 51 is provided for carrying away the mined material.

Each support 1*b* is pivotally connected to the piston rod 8*a* of respective cylinders 8 whose opposite ends are pivotally connected at 8*b*, for example, to the chassis of the machine (not shown).

Let us assume that all of the auger sections 2 are initially in line and are urged toward the face 9 of the tunnel from which the coal is to be excavated. By advancing the upper piston rod of the auger section 2*a* and its apron 1*a* to a greater extent than the lower piston rod, the auger section 2*a* is rotated in a counterclockwise sense about its articulation with the auger section 2*b* and attacks the coal front in an inclined position. The lower piston rod is then advanced and excavation continues until the upper section has reached the position shown in FIG. 1. Naturally, this inclines the next section 2*b* which has been shown in FIG. 1 as about to complete its excavating action. The greatest amount of excavation is here being effected by the section 2*c* while the lesser amount is effected by the section 2*d*.

A comparison of FIGS. 1 and 2 shows that the most inclined section effects the greatest amount of excavation and that the excavation proceeds across the coal face over the length of the assembly. The excavated detritus is carried to the conveyor 51 by the worm-conveyor action of the augers along the aprons 1. The coal front 2 is thus progressively set back.

When all of the piston rods are fully extended, the machine chassis is advanced and the process is repeated. The cylinders 8 can be hydraulic cylinders.

The greatest degree of excavation is thus effected with the auger section inclined from 5° to 50° to the axis of the adjustment auger sections. In the embodiment of FIGS. 1 and 2, moreover, three auger sections are always inclined and, of course, a greater number or lesser number can be engaged in active attack on the coal face as desired.

According to the invention, as each auger section is inclined, relative to the next auger section, water is fed to nozzles in the inclined auger section for spraying upon the detritus and the coal face, thereby minimizing sparking and wetting down the dust.

Figure 7:
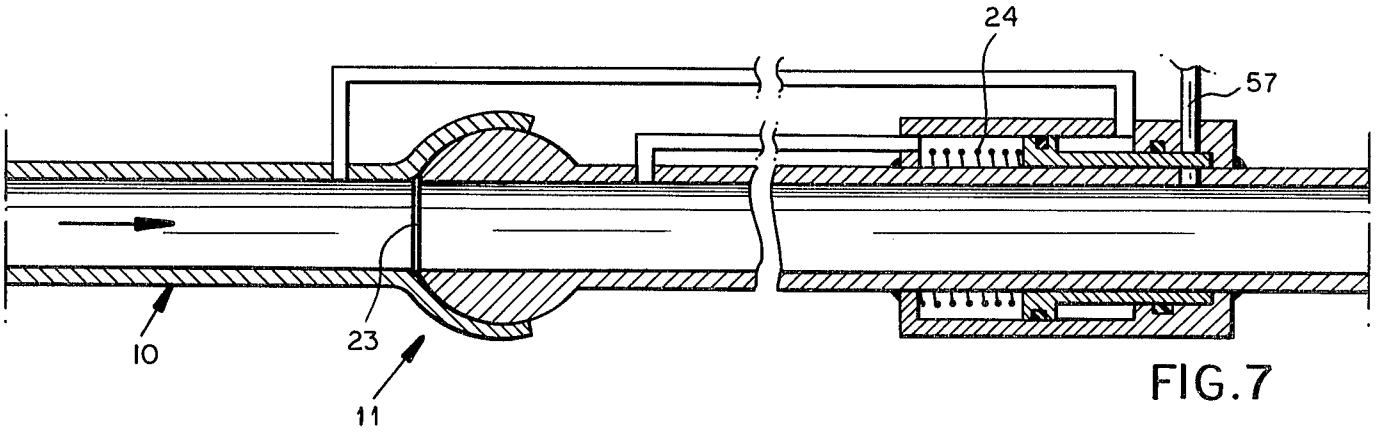
FIG. 7 is an axial section through an articulation provided with a valve in accordance with another embodiment of this invention.
Figure 8:
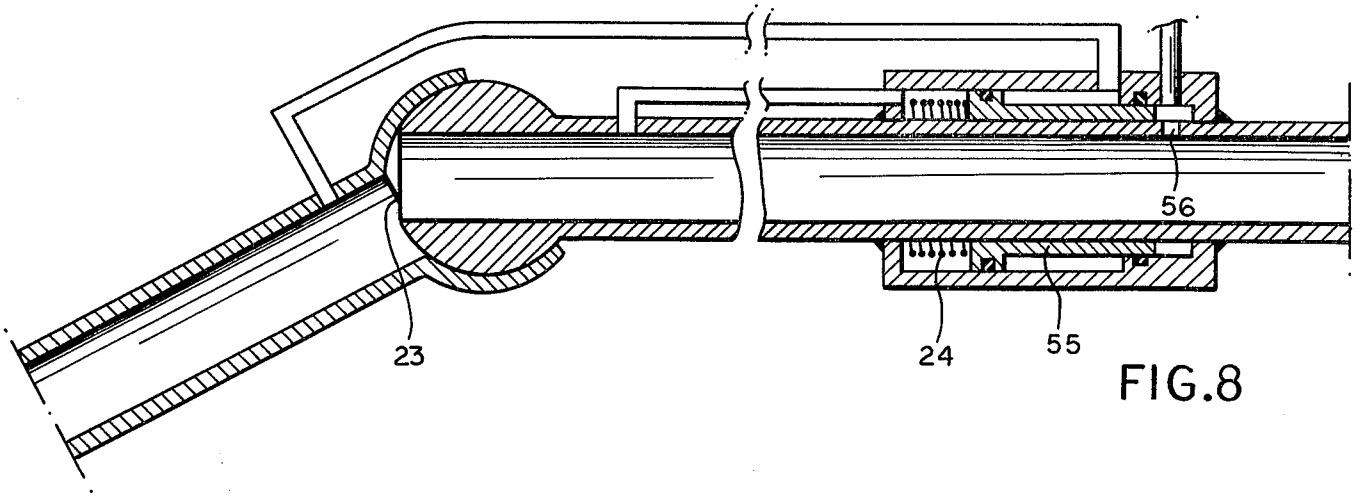
FIG. 8 is a section similar to FIG. 7 but showing the parts thereof in another position.
Figure 9:
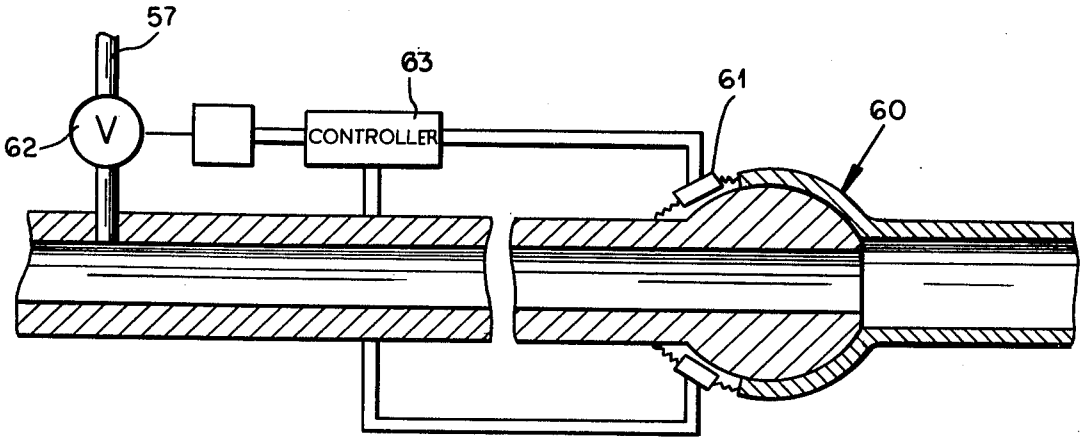
FIG. 9 illustrates yet another embodiment of the invention in a sectional view.

FIGS. 3 through 8 show the mechanical systems for controlling this water supply whereas FIG. 9 illustrates an electrical system for this purpose.

In FIGS. 3 through 8 the auger section shafts 5 are hollow and connected to a water supply pipe 10 forming a source of water.

The water supply pipe 10 in the region of the universal or Cardan joint 6 is provided with a fluid connection which has been represented at 11.

As can be seen from FIG. 3, the shaft 5 carries a helical flight 3 which is formed on its outer periphery with bearing for picks 4 adapted to remove the coal from the seam. The picks 4 are each formed with a nozzle 12*b* for directing a jet or spray 12*c* of water onto the coal face in the region of the sector of the auger which is active. In FIG. 3 this sector corresponds approximately to the sector between the 7 o'clock and 10 o'clock positions of the auger.

The nozzles 12*b* receive the water through radial bores 12*a* formed directly in the helical flight 3; the bores 12*a* of a given sector are connected to a common axial passage 12*d*, the passages 12*d* being connected via respective tubes 12 to a distributing valve 13 in the region of the axis and serving to both control flow of liquid to the auger and distribute the flow exclusively to the nozzles which are actively engaged in excavation. The valve has been represented at 13 and cooperates with an actuating device generally represented at 14 and serving to open the flow of liquid only when the auger is inclined to the next section. In the noninclined or axially aligned position, the valve 13 is closed.

Figure 4:
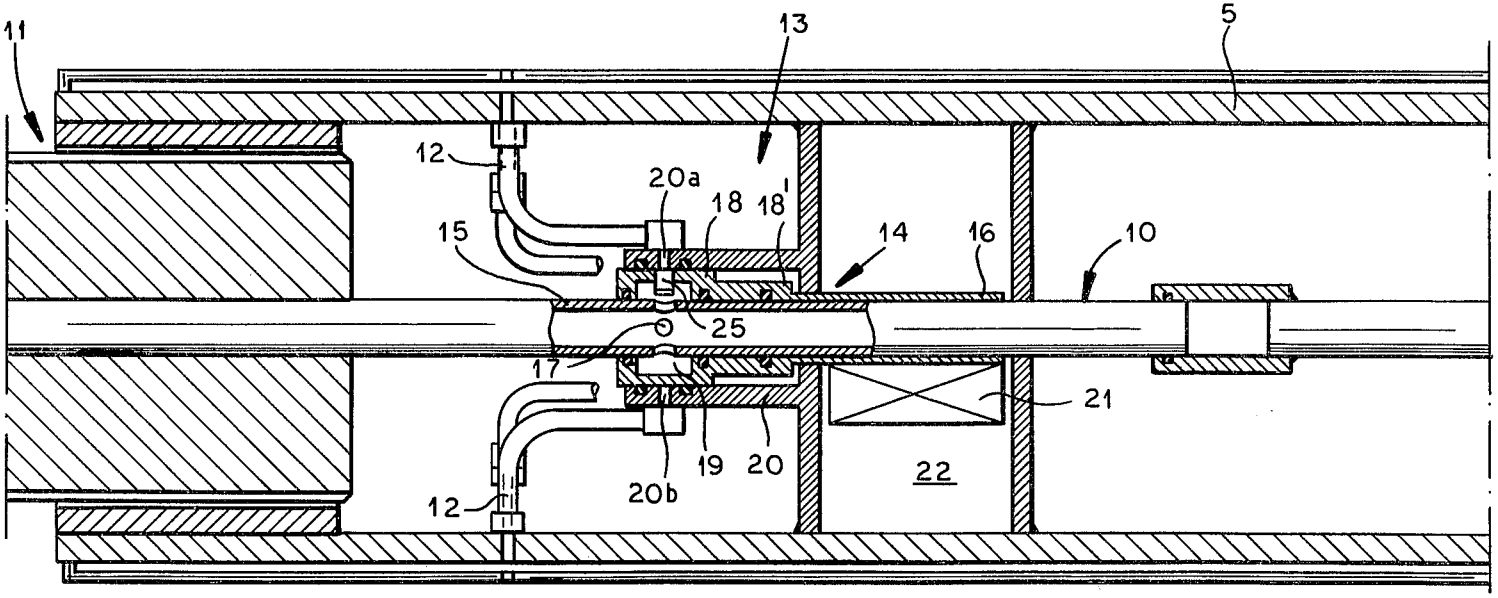
FIG. 4 is an axial section taken through a portion of a shaft of the type shown in FIG. 3 yet drawn to a larger scale.
Figure 5:
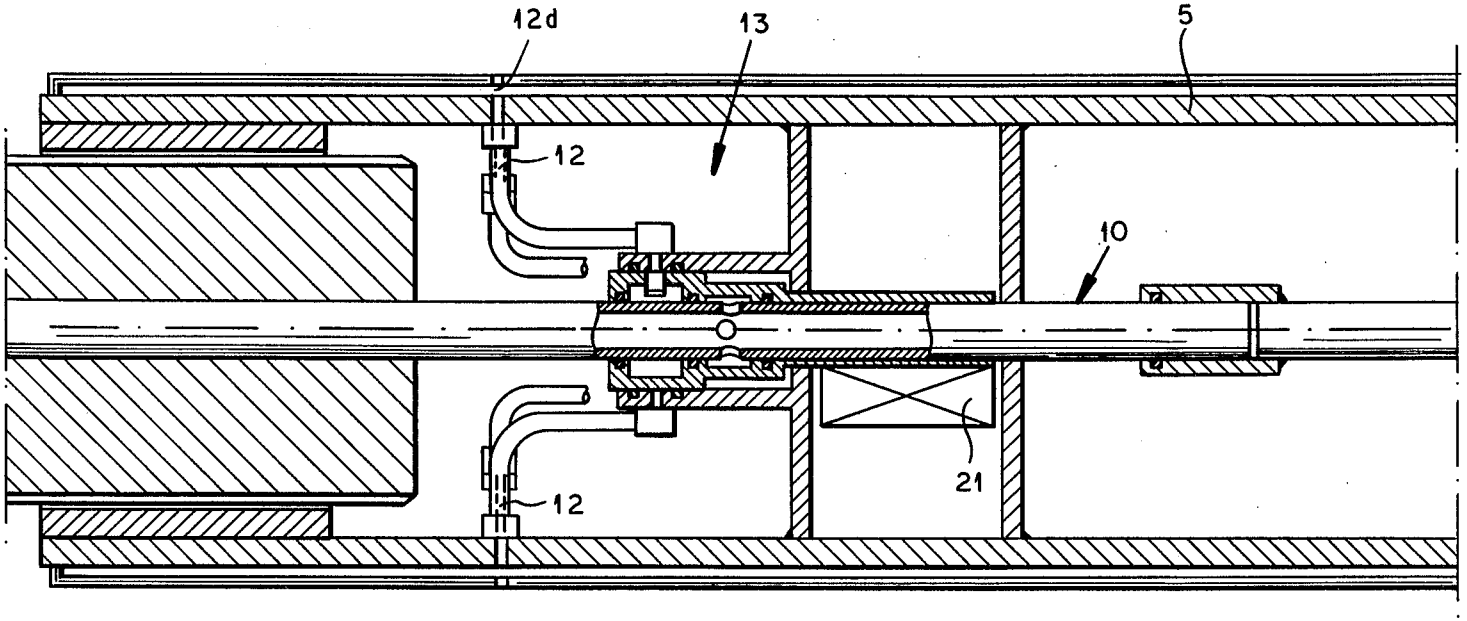
FIG. 5 is a view similar to FIG. 4 showing the parts therein in another operative position.

From FIGS. 3 through 5 it will be apparent that the Cardian universal joints 6 are provided with axial compensation, i.e. the two shafts move toward one another in the aligned position and away from one another in the inclined position (compare FIGS. 4 and 5). This axial compensation is used to actuate the valve.

In FIGS. 4 and 5 the length compensation unit 14 comprises telescopic tube parts including an inner tube 15 and an outer tube 16. The inner tube 15 is formed with water outlet ports 17 while the outer tube 16 carries an opening cylinder 18 whose cylinder chamber 19 communicates with the passage 12 via a segment-shaped opening 25 and a blocking sleeve 20 of the rotatable member 5 which has ports 20*a*, 20*b*, etc. for each of the tubes 12 which are angularly spaced about the valve axis.

In the aligned position of the auger sections, the tube 15 is shifted relative to the right (FIG. 5) so that the sleeve portion 18' of cylinder 18 blocks the ports 17 and fluid is not delivered to the tubes 12.

However, upon angular offsetting of two articulated auger sections, tube 15 shifts relatively to the left (FIG. 4) so that the port 17 opens into the chamber 19 and can communicate with the passage 25. Passage 25 is oriented to communicate with the port of tube 12 running to the nozzles which are turned in the direction of the coal face. This orientation of the outlet 25 is maintained by the eccentric weight 20 connected to the cylinder 18 hanging downwardly in the compartment 22 while the shaft 5 rotates.

In the embodiment of FIGS. 7 and 8, the articulation 11 forms a throttle in a flow passage whose flow cross section 23 is smaller upon inclination of one auger section relative to the other. In the aligned position (FIG. 7) there is no pressure differential across the joint. However, upon inclination of one auger section relative to the other, the flow is throttled and a pressure differential is applied across the piston 55 to unblock a passage 56 which can communicate with a port 57, supplying, for example, a distributing valve as shown in FIG. 4 and constituting the equivalent of a bore 17 thereof.

The piston 55 is biased into its closed position, when the pressure differential disappears by a spring 24.

In FIG. 9, the joint 60 is formed with strained gauge strips 61 which are resiliently coupled to two relatively tiltable members of the joint so that flow through the line 57 can be controlled at electromagnetic passage 62 where the strain gauges 61 operate a controller 63 to signal the angular offset of the two auger sections.

In the embodiments of FIGS. 7 through 9 the liquid is supplied by any conventional pump from a reservoir (not shown) to the hollow shaft.

We claim:

1. In a broad-face coal-mining machine comprising a multiplicity of auger sections articulated to one another in an end-to-end relationship and provided with respective guide aprons whereby said auger sections are successively inclined relative to an adjoining auger section for excavation of coal from a tunnel front and rotation of said auger sections carries excavated coal along said aprons to remove the same, the improvement which comprises in combination:

nozzles on said auger sections for dispensing a liquid capable of wetting dust and preventing sparking;

a pipe for supplying said liquid to said auger sections;

valve means between said pipe and the nozzles of the auger sections responsive to the inclination thereof for feeding said liquid to the nozzles of an inclined auger section and limiting flow to a non-inclined auger section; and actuating means operatively connected to said valve means and responsive to the degree of inclination of an auger section relative to an adjoining auger section whereby said valve means is opened upon sufficient inclination and is closed with insufficient inclination.

2. The improvement defined in claim 1 wherein said auger sections are connected by universal joints having length-compensating means, forming said actuating means.

3. The improvement defined in claim 2 wherein each auger section is formed with a hollow shaft supplying said liquid, said valve means including a valve sleeve surrounding said shaft, said shaft being axially shiftable relative to said sleeve, said sleeve having at least one outlet port communicating with said nozzles and said shaft being movable relative to said sleeve from a position wherein said shaft communicates with said outlet port and a position wherein said outlet port is disconnected from communication with said shaft.

4. The improvement defined in claim 2 wherein said universal joint forms a variable throttle for said liquid, said actuating means comprising means for tapping a pressure differential from across said throttle, said valve means having an outlet port communicating with said nozzles, and a piston controlled by said pressure differential for selectively blocking and unblocking said outlet port.

5. The improvement defined in claim 3 or claim 4 wherein said outlet port is formed on a relatively angularly fixed member, each auger comprising a rotatable member formed with passages communicating with nozzles along respective sectors of the auger for successively connecting said passages to said outlet port whereby discharge of said liquid from each auger is confined to a region at which each auger engages said coal front.

* * * * *